US006397418B1

(12) United States Patent
Stjerna

(10) Patent No.: US 6,397,418 B1
(45) Date of Patent: Jun. 4, 2002

(54) DOUBLE SPRING MATTRESS AND MANUFACTURING PROCESS

(75) Inventor: NilsEric Stjerna, Herrljunga (SE)

(73) Assignee: Stjernfjadrar AB, Herrljunga (SE)

( * ) Notice: Subject to any disclaimer, the term of this patent is extended or adjusted under 35 U.S.C. 154(b) by 0 days.

(21) Appl. No.: 09/581,791

(22) PCT Filed: Dec. 10, 1998

(86) PCT No.: PCT/SE98/02275

§ 371 (c)(1),
(2), (4) Date: Aug. 7, 2000

(87) PCT Pub. No.: WO99/35081

PCT Pub. Date: Jul. 15, 1999

(30) Foreign Application Priority Data

Dec. 19, 1997 (SE) ..... 9704746

(51) Int. Cl.[7] ..... B68G 9/00; A47C 23/04
(52) U.S. Cl. ..... 5/720; 5/655.8; 267/91.1
(58) Field of Search ..... 5/720, 655.8; 267/91; 53/114; 29/91.1, 91

(56) References Cited

U.S. PATENT DOCUMENTS

| | | | | |
|---|---|---|---|---|
| 871,871 A | | 11/1907 | Hirschman | |
| 1,703,587 A | | 2/1929 | Kraft | 5/720 |
| 1,741,847 A | | 12/1929 | Kasper | 5/655.8 |
| 2,461,062 A | * | 2/1949 | Kane | 5/720 |
| 4,234,984 A | * | 11/1980 | Stumpf | 5/720 |

* cited by examiner

*Primary Examiner*—Alexander Grosz
(74) *Attorney, Agent, or Firm*—Birch, Stewart, Kolasch & Birch, LLP

(57) ABSTRACT

The present invention relates to a spring mattress having two superposed layers of springs, which are enclosed in covers, and a method of manufacturing a mattress of this kind. The characterizing features of the invention are that the springs of the upper layer are positioned essentially straight above the corresponding springs in the lower layer, and that the covers are joined together in such a manner that the springs in the lower layer are affected at least to some extent by the spring above, in the upper layer, independently of neighboring springs.

14 Claims, 4 Drawing Sheets

DOUBLE SPRING MATTRESS AND MANUFACTURING PROCESS

This application is the national phase under 35 U.S.C. §371 of PCT International Application No. PCT/SE98/02275 which has an International filing date of Dec. 10, 1998, which designated the United States of America.

BACKGROUND OF THE INVENTION

1. Field of the Invention

The present invention relates to a spring mattress having two superposed layers of springs, which springs are enclosed in covers, and to a method of manufacturing a mattress of this kind.

2. Description of Background Art

One common technique for manufacturing spring mattresses is known as the "pocket technique". According to this technique, the springs are enclosed in pockets, i.e., they are enclosed individually by a covering material. Owing to this arrangement, the springs become individually resilient, such that each spring may flex separately without affecting neighboring springs, which increases the user's comfort, since the load will be distributed more evenly across the surface that receives the load.

In order to further enhance comfort, two super-posed layers of pocket springs are used in some cases, i.e., a structure, which in principle consists of two joined-together pocket spring mattresses. In this type of mattress the load exerted on the mattress by the user is distributed further, and the mattress is felt as more comfortable.

One problem found in this type of mattresses is, however, that they are complex and time-consuming to manufacture and in addition, much material is required, since in principle it is necessary not only to manufacture two conventional pocket spring mattresses but also to join the two mattresses together.

A further problem encountered in this type of mattresses is that only the springs in the uppermost layer are individually resilient. Because of the material of the covers, the force exerted on the lower-layer springs by the lower parts of the loaded upper-layer springs is distributed over the upper layer, and from there it is distributed over several springs in the lower layer. This detracts from the individual resilience of the bottom-layer springs and consequently this layer contributes only marginally to the comfort of the mattress.

SUMMARY AND OBJECTS OF THE INVENTION

One object of the present invention thus is to provide a spring mattress of the kind defined in the introduction hereto, and to suggest a method of manufacturing said mattress, wherein the disadvantages referred to above are completely or at least partly eliminated.

This object is achieved by a spring mattress and a manufacturing method therefor as defined in the appended claims.

Further scope of applicability of the present invention will become apparent from the detailed description given hereinafter. However, it should be understood from the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
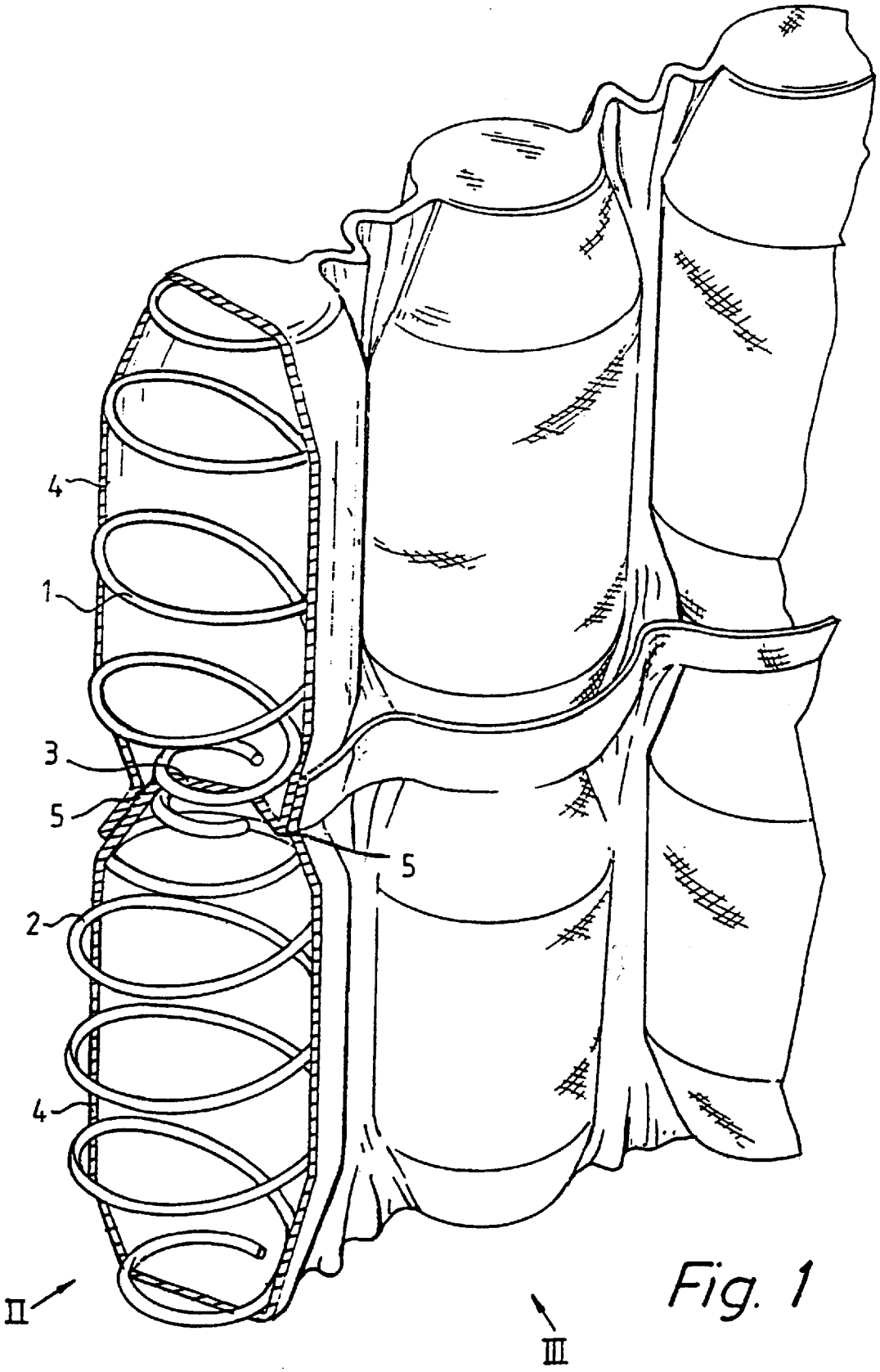
FIG. 1 is a partly broken, perspective view of a mattress in accordance with the invention.
Figure 2:
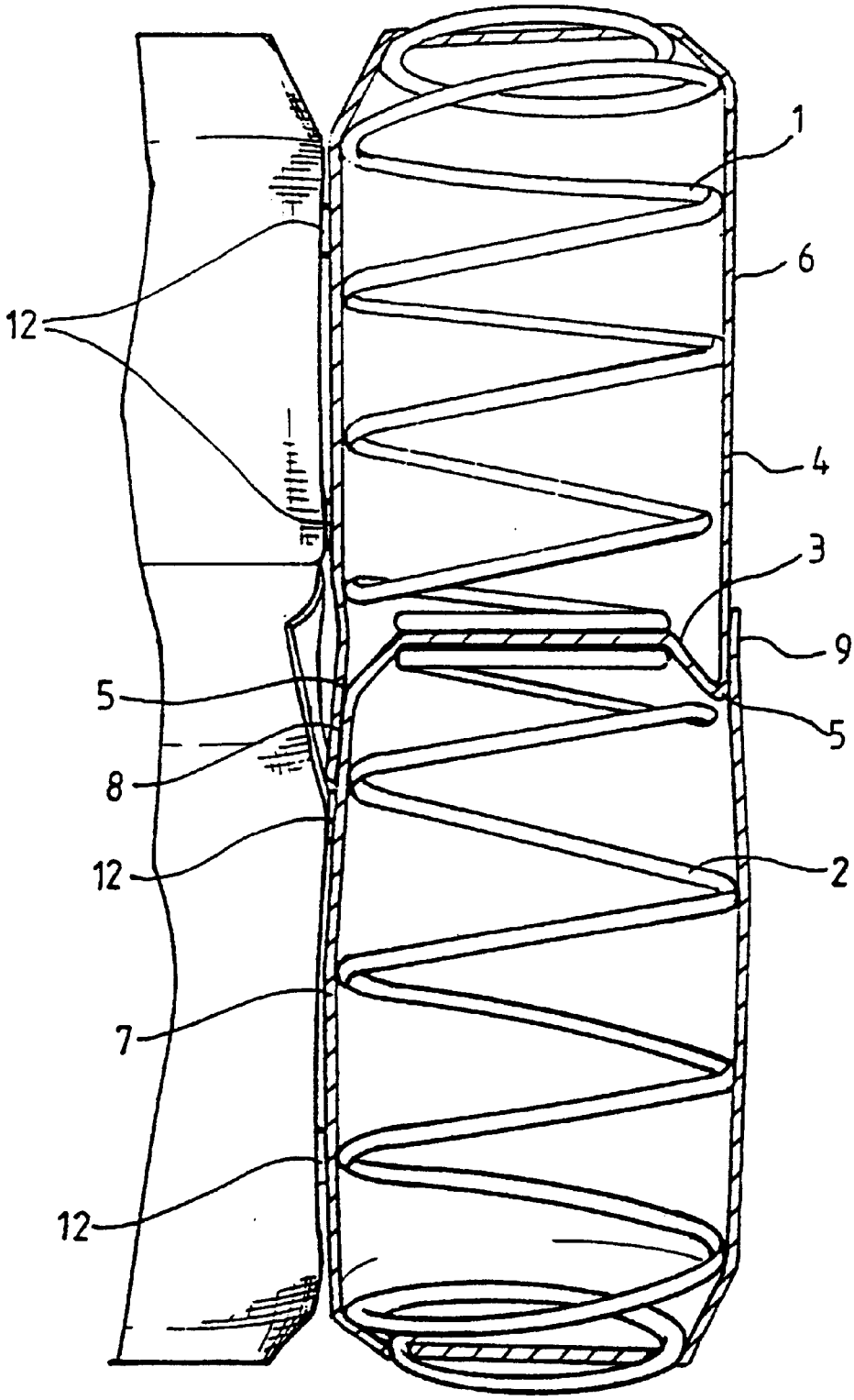
FIG. 2 is a lateral partly broken view of a first side of the mattress looking in the direction of arrow II of FIG. 1.

As appears from FIGS. 1 and 2, a spring mattress in accordance with the invention comprises two layers of springs, the springs of both layers being essentially in alignment with one another in such a manner that the springs of the upper layer 1 are positioned essentially straight above the corresponding springs of the lower layer 2.

Upper and lower springs 1, 2 are enclosed in covers, the facing ends of which preferably consisting of a common partition wall 3. In this manner the covers form a common external cover 4 around one pair of springs 1, 2 and one partition wall 3, which is joined to the external cover 4.

Preferably, the cover is made from a textile material and advantageously it is of a type that may be welded, but also other types of material, such as various kinds of plastic materials, may be used.

The extension of the partition wall 3 between the junctions 5 to the external cover 4 exceeds that of the pair of springs 1, 2 abutting against said portions. Owing to this arrangement, the part of the partition wall 3, against which the pair of springs 1, 2 abuts, is movable between an upper and a lower end position without affecting the external cover 4 at the areas of junction 5 of the partition wall 3 to the external cover 4. In this manner, the pair of springs 1, 2 in the two layers may flex individually between these end positions within the area of extension inside the cover.

More specifically, in the spring mattress in accordance with this embodiment, the springs in the lower layer are more strongly biased than those in the upper layer. Consequently, the lower springs will urge the partition wall 3 upwards, to the upper position thereof, which is illustrated in FIGS. 1 and 2, when there is no load on the mattress. Upon increasing load on the mattress, only the springs 1 of the upper layer will be compressed initially. At a predetermined threshold value of the force exerted by the upper springs on the lower springs, the lower springs 2 also will eventually be compressed and be individually resilient up to the point, at which the partition wall reaches its lower end position (not shown). In this manner, the mattress is given a soft upper layer, which distributes the load across the entire surface of contact between the user's body and the mattress, and a harder lower layer adapted to take the load exerted, for example, by the user's buttock and shoulder regions while at the same time all springs at least to some extent are individually resilient. In this manner, the mattress serves to straighten out the user's spine while at the same time the supporting/carrying force is distributed so as to prevent blockage of the circulation of the blood. As a result, the mattress is imparted excellent qualities of comfort and is felt as very comfortable.

The above mattress preferably is manufactured by applying a piece of material in such a manner that it extends between one pair of springs, whereby the portion of the material that thus extends between the springs will form the partition wall 3. The material ends 6 and 7, respectively, externally of the springs, are then carried round their respective spring of the pair and are attached to the piece of material on the opposite side in overlap areas 8 and 9, respectively, as clearly illustrated in FIG. 2. The external cover 4 and the partition wall 3 thus are formed from the same continuous piece of material, which saves material and also makes possible rational manufacture of the mattresses.

The remaining sides, i.e., those in parallel with the plane of the drawing of FIG. 2, are thereafter joined together so as to completely enclose the springs inside the cover. This step preferably is effected by welding or gluing.

Figure 3:
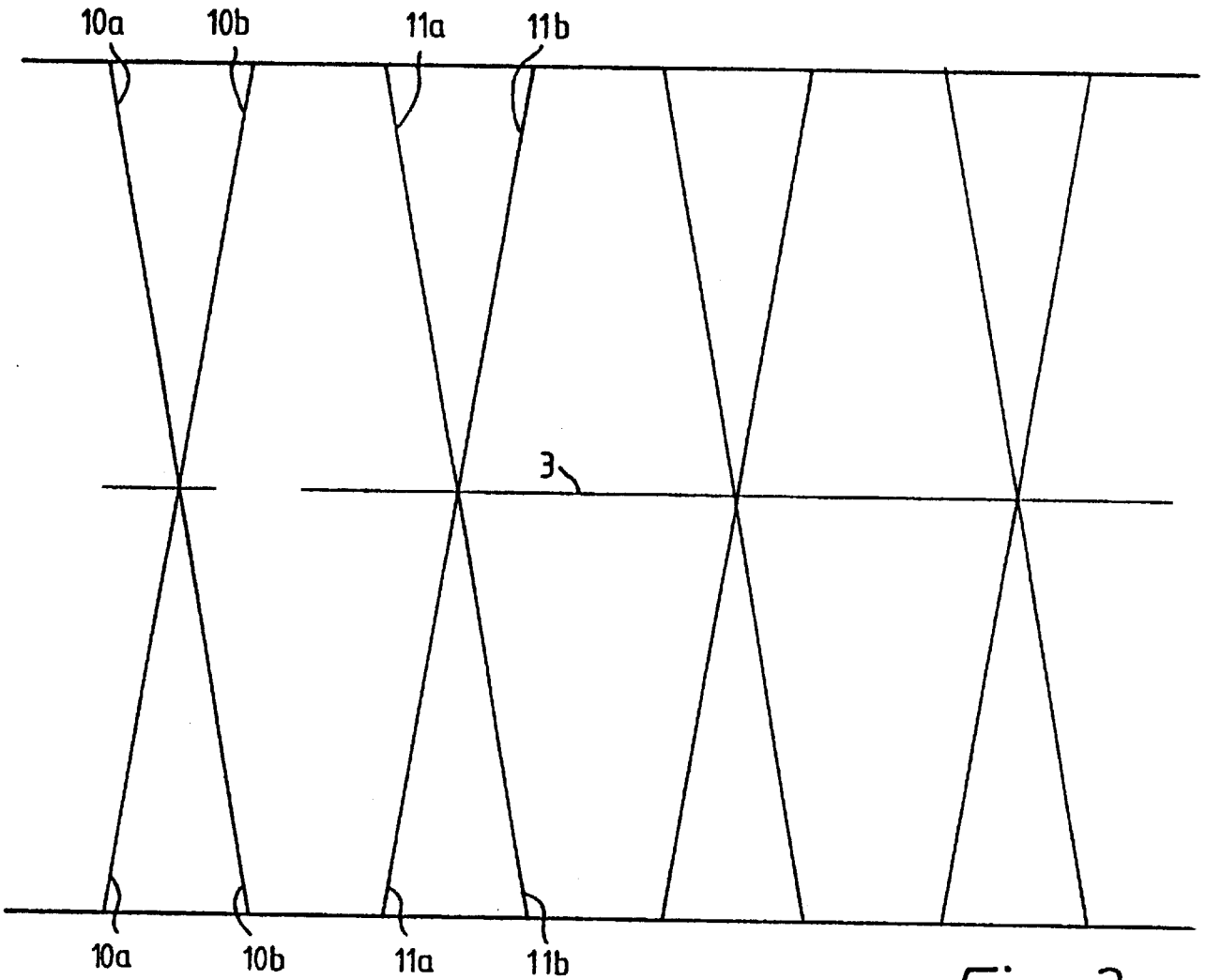
FIG. 3 is a schematic view of the cover of the mattress as seen from the direction of arrow III of FIG. 1, and without springs having been inserted.

Preferably, the same piece of material also is used to encase several pairs of springs, as illustrated in FIG. 2. The welding between neighboring springs preferably is carried out in such a manner as to ensure that there will be more material between the lateral interconnecting joints at the middle of the external cover, i.e., in the area where the springs of the pair abut against one another, than at the top and bottom regions of the external cover. This is illustrated schematically in FIG. 3, showing the material of the cover but without springs as seen from the direction of arrow III of FIG. 1. Attachment lines 10*a, b* and 11*a, b* are arranged between neighboring external covers, the weld seams at the top and bottom splitting into two seam parts that are directed away from one another with a gradually growing spacing between them upwards and downwards. In this manner it is ensured that the distance between two lateral attachment lines 10*b*, 11*a* of one and the same external cover along the material of the cover is longer at the middle of the external cover, i.e., in the area of the partition wall 3, than at the top and bottom, respectively. This arrangement contributes to the movability of the partition wall 3 in the lengthwise direction of the springs relative to the external cover.

As already mentioned, the covers enclosing a spring pair preferably are disposed in successive rows, which are then attached to one another, side by side, as indicated in FIG. 2. Preferably, the rows are attached in two or three vertically spaced attachment points 12 opposite each spring. A larger or smaller number of attachment points is, of course, possible. It is likewise possible to provide for a longer line of attachment extending essentially in parallel with the longitudinal direction of the springs, instead of using several shorter attachment points.

Interconnection of rows may be effected by welding or gluing, in the same way as the previous attachment within individual rows. However, as an alternative, staples or clips may be used, as also Velcro® tape or other fastening means.

Figure 4:
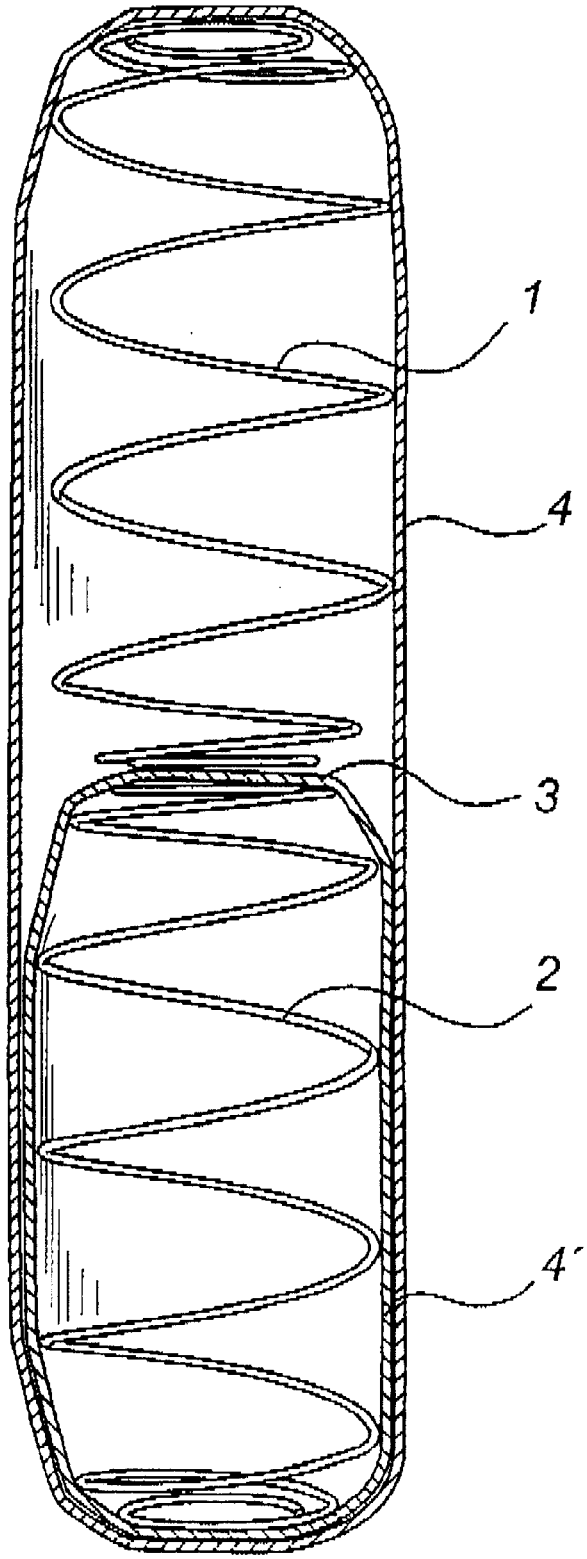
FIG. 4 shows a second embodiment of the present invention, looking in the same direction as in FIG. 2.

The invention has been described herein by way of one embodiment. Several varieties of the invention are, however, possible. For instance, it is not necessary to manufacture the partition wall and the external cover from the same piece of material but the external cover could be manufactured separately. In this second embodiment, the springs of the lower layer are enclosed in inner covers 4', the external covers 4 being applied around the inner cover 4' and the spring housed therein, as well as around the corresponding spring in the upper layer. This embodiment is shown in FIG. 4. In this second embodiment, the partition wall is attached in at least some points to the inner face of the cover. The partition wall need not in this case be a full wall but could be configured as a smaller bridge extending between diametrically opposite points on the external cover.

Another alternative embodiment, which produces a larger longitudinal range of individual resilience but which requires more material, is to arrange a separate cover that encloses one of the springs of the pair of springs and thereafter apply a larger external cover around both springs of the pair. In addition, it is not either necessary, first to arrange the external covers in rows and then join together these rows to form mattresses, but separate external covers could be joined together directly to form a mattress.

Advantageously, the springs are all of the same type, i.e., they have identical wire thickness and essentially identical resilience properties, the difference in resilience properties in the springs of the two layers being achieved by biasing the springs differently. However, it is of course equally possible to use different types of springs. In addition, the springs are shown having tapering ends. This configuration is not, however, necessary but alternatively the springs could have the same diameter size throughout or even be formed with diameters of increasing size towards the ends, i.e., they could be of the spring type known as double-cone springs.

These and other obvious varieties must be regarded to be within the scope of protection of the invention as the latter is defined in the appended claims.

What is claimed is:

1. A spring mattress comprising:

two superposed layers of springs, the two layers having an upper layer and a lower layer, and covers for enclosing the springs, wherein:

the springs of the upper layer are positioned essentially straight above the corresponding springs in the lower layer, and in that the covers are joined together in such a manner that the springs in the lower layer are affected at least to some extent by the spring above in the upper layer independently of neighboring springs.

2. The spring mattress as claimed in claim 1, wherein:

the corresponding springs in the two layers are enclosed in pairs in an external cover, to which an external cover is joined a partitioning bridge in the form of a partition wall, which extends between opposite sides, between the springs, and the dimensions of said bridge between the junctions to the external cover at least somewhat exceeding the dimension of the spring ends abutting against said portions, which arrangement imparts at least some movability to the partition wall in the longitudinal axis of the springs.

3. A spring mattress as claimed in claim 2, wherein the external cover as well as the partition wall are made from one continuous piece of material.

4. The spring mattress as claimed in claim 3, wherein a middle part of the piece of material forms the partition wall (3), and in that sides of the material piece are attached in the vicinity of said partition wall.

5. The spring mattress as claimed in claim 3, wherein several external covers are joined together in rows, the partition between the covers being effected by joining together the covers by means of gluing or welding.

6. The spring mattress as claimed in claim 1, wherein the springs of the two layers possess different resilience properties, preferably by having different bias in such a manner that the springs of the lower layer are stiffer than the springs of the upper layer.

7. The spring mattress as claimed in claim 1, wherein the cover material consists of a weldable textile material, which is joined together by means of gluing or welding.

8. The spring mattress as claimed in claim 1, wherein the springs of the lower layer are enclosed in inner covers, the external covers being applied around one inner cover and the spring housed therein, as well as around the corresponding spring in the upper layer.

9. A method of manufacturing a mattress having two superposed layers of springs, which springs are enclosed in covers, comprising the steps of:

placing a piece of material between corresponding springs in the two layers, wrapping external ends of said material around the respective spring, joining said ends to the piece of material at the opposite side of the respective one of the springs, and attaching the piece of material along the longitudinal sides, i.e., in the longitudinal direction of the springs.

10. The method as claimed in claim 9, wherein the ends of the piece of material are attached in such a manner that the part of the material being arranged between the springs, in its extension between the points of attachment, is larger than the extension of the end portions of the springs.

11. The method as claimed in claim 9, wherein several covers positioned in rows are interconnected at their longitudinal sides by joining together continuous pieces of material between neighboring springs.

12. A method as claimed in claim 11, wherein the joining together of the material between neighboring springs in said rows is effected in such a manner that the extension of the covers at right angles to the longitudinal direction is larger at the middle than at the top and bottom, respectively.

13. The method as claimed in claim 9, wherein the material that is used is a weldable textile material, and the joining together of the material is effected by gluing or welding.

14. The method of manufacturing a mattress having two superposed layers of springs, which springs are enclosed in covers, comprising the steps of:

enclosing a spring in an inner cover, and enclosing the inner cover with the spring positioned therein, as well as a corresponding spring in the second layer, in an external cover.

* * * * *